US010612169B2

(12) United States Patent
Enishi et al.

(10) Patent No.: US 10,612,169 B2
(45) Date of Patent: Apr. 7, 2020

(54) KNITTING MECHANISM FOR CIRCULAR KNITTING MACHINE AND THE CIRCULAR KNITTING MACHINE

(71) Applicant: PRECISION FUKUHARA WORKS, LTD., Kobe (JP)

(72) Inventors: Masaru Enishi, Kobe (JP); Sergio Delgado, Mataró (ES)

(73) Assignee: PRECISION FUKUHARA WORKS, LTD., Hyogo (JP)

( * ) Notice: Subject to any disclaimer, the term of this patent is extended or adjusted under 35 U.S.C. 154(b) by 180 days.

(21) Appl. No.: 15/486,856

(22) Filed: Apr. 13, 2017

(65) Prior Publication Data

US 2018/0298533 A1 Oct. 18, 2018

(51) Int. Cl.
*D04B 15/68* (2006.01)
*D04B 15/82* (2006.01)

(52) U.S. Cl.
CPC ..... *D04B 15/68* (2013.01); *D04B 15/82* (2013.01)

(58) Field of Classification Search
CPC .... D04B 15/32; D04B 15/322; D04B 15/325; D04B 15/327; D04B 15/34; D04B 15/78; D04B 15/68; D04B 15/82
See application file for complete search history.

(56) References Cited

U.S. PATENT DOCUMENTS

| | | | | |
|---|---|---|---|---|
| 3,940,950 A | | 3/1976 | Sawazaki | |
| 3,996,769 A | | 12/1976 | Schindele et al. | |
| 4,793,159 A | | 12/1988 | Sawazaki | |
| 4,989,425 A | * | 2/1991 | Furia | D04B 15/78 66/220 |
| 5,027,619 A | | 7/1991 | Saito | |
| 5,359,865 A | * | 11/1994 | So | D04B 1/126 66/19 |
| 5,689,977 A | * | 11/1997 | Yorisue | D04B 15/34 66/215 |
| 5,775,135 A | * | 7/1998 | Shibata | D04B 15/34 66/216 |

FOREIGN PATENT DOCUMENTS

| | | |
|---|---|---|
| EP | 0722007 | 7/1996 |
| EP | 1867768 | 12/2007 |
| JP | S50-58347 | 5/1975 |
| JP | H 6-94619 | 11/1994 |
| JP | H9-111621 | 4/1997 |

OTHER PUBLICATIONS

Extended European Search Report for corresponding European Application No. 16195821.0 dated Mar. 28, 2017, 8 pages.

* cited by examiner

*Primary Examiner* — Danny Worrell
(74) *Attorney, Agent, or Firm* — Alston & Bird LLP

(57) ABSTRACT

Provided is a knitting method and a knitting mechanism, and a circular knitting machine, in which in jacquard or semi jacquard knitting using a circular knitting machine, welt stitching is avoided so as to prevent the breakage and overlapping of yarns and filaments. According to the present invention, only needles selected for knitting and needles selected for tucking perform stitching, and needles selected for welting are prevented from performing stitching by a deactivation method, and thus the needles selected for welting do not perform stitching, so that the load on old loops can be suppressed, and breakage and overlapping of yarns and filaments can be prevented.

7 Claims, 4 Drawing Sheets

KNITTING MECHANISM FOR CIRCULAR KNITTING MACHINE AND THE CIRCULAR KNITTING MACHINE

BACKGROUND OF THE INVENTION

Field of the Invention

The present invention relates to a knitting method and a knitting mechanism for a circular knitting machine, and the circular knitting machine, used in various jacquard machines and the like.

Description of Related Art

Jacquard machines and the like for performing semi jacquard knitting or jacquard knitting in circular knitting machines include a needle selector that performs needle selection. Needle selection involves switching knitting tools such as needles and sinkers between an operation state and a non-operation state, thereby changing the routes of the knitting tools. The routes of the knitting tools are changed by the needle selector, and, in the case of needles, needle routes may be one selected mainly from those for 3-position knitting structures consisting of knit, tuck, and welt, and knitting is thus performed.

As such a needle selection method, an electromagnetic needle selector that is a combination of an electromagnetic actuator, a selecting jack, and a rocking piece, for example, as shown in JP H9-111621A, has been disclosed. Also, a needle selector using a piezoelectric element that is a combination of a multi-stage piezoelectric actuator and a patterning jack, for example, as shown in JP H6-94619B, and a mechanical needle selector using a multi-stage peg holder instead of a multi-stage piezoelectric actuator, for example, as shown in JP 550-58347A, are known.

The needle selecting methods using these electrical and mechanical needle selectors make it possible to select any one of knit, tuck, and welt for each needle. The needle selection is based on the principle that, at an entrance portion of a cam disposed at each feeder where a yarn is fed to a needle, first a selection is made as to whether a needle that moves due to rotation of a knitting machine is to be raised or to be kept at its current position, and, if it is determined that the needle is to be raised, the needle is raised to a position around the center of the cam, and before the needle reaches a yarn feeding position, a selection is made as to whether the needle is to be further raised or to be kept at its current position. That is to say, in the case of knit, the needle is first raised, then further raised, and receives a fed yarn. In the case of tuck, the needle is first raised, is then kept at its current position, and receives a fed yarn. In the case of welt, the needle is kept at the first position. Subsequently, as guided by the cam, the needles at the knit and tuck positions are lowered, after which all needles including the needle selected for welting perform stitching and are returned to their original positions so as to be placed into the next feeder.

The selecting mechanism used is such that when raising a needle, a cam is caused to guide a butt of the needle and raise the needle, and, when keeping a needle at its current position, the needle or a jack provided on the lower portion of the needle is pushed in a direction that is perpendicular to the rotational direction of a cylinder and the like of the knitting machine to detach the butt from the cam, and thus guidance by the cam is deactivated and the needle is kept at its current position.

Needle selection for tucking may not be performed depending on the machine specifications, but various jacquard machines select a knitting structure for each needle by performing needle selection once or twice before the needle reaches a yarn feeding position, making jacquard or semi jacquard knitting possible.

SUMMARY OF THE INVENTION

In order to perform jacquard or semi jacquard knitting, knitting structures are selected according to needle selection prior to feeding a yarn. After the yarn is fed, needles for knitting and tucking that received a fed yarn have to perform stitching, and thus the cam structure is such that all needles also including needles for welting are uniformly lowered as guided by the cam and perform stitching, after which the needles return to their initial height and are placed into the next feeder, that is, needles for welting also perform stitching as in the case of needles for knitting and tucking. However, needles for welting do not receive a fed yarn, and thus they do not necessarily have to perform stitching.

Recently, there is demand for knitted fabrics with higher quality, and it has been found that the welt stitching is a problem that needs to be solved in order to improve the quality. As knitting conditions become sophisticated and more complicated, the welt stitching is more likely to cause breakage in yarn or filaments and affects the quality of knitted fabrics.

For example, since yarns that easily break due to their low tolerance to a pulling force, such as fragile yarns, hard yarns, and thin yarns are being used move often, and loops are becoming tighter due to increasingly fine gauges of knitted fabrics, the welt stitching is more likely to cause breakage in the yarn or filaments. Since an old loop in the hook of a needle selected for welting has already been stitched and its size has been determined, if a stitch at a size that is the same as or greater than the determined size is performed in a subsequent welt, the load on the old loop is large. Furthermore, since a larger number of colors are being used for a knitted fabric, the number of welt feeders increases, and thus by performing stitching on the same loop a plurality of times, breakage in yarn or filaments is more likely to occur. Furthermore, even in the case of stout yarns that are unlikely to break, a so-called overlapping occurs in which the size of an old loop is increased due to stitching and a latch enters the old loop again during knitting.

It is an object of the present invention to provide a knitting method and a knitting mechanism, and a circular knitting machine using the same, in which welt stitching is avoided so as to prevent the breakage and overlapping of yarns and filaments.

The present invention is directed to a knitting method realized by selecting needles inserted in needle grooves, on a knitting member including the needle grooves in a circular knitting machine, wherein only needles selected for knitting and needles selected for tucking perform stitching, and needles selected for welting are prevented from performing stitching by a deactivation method.

With this method, needles selected for welting do not perform stitching, and thus stitched old loops are not excessively pulled, and the load on the old loops can be suppressed. Accordingly, breakage and overlapping of yarns and filaments can be prevented.

Examples of the knitting member include a cylinder and a dial, and needle selection methods may be methods using electrical devices such as an electromagnetic needle selector or a multi-stage piezoelectric actuator, mechanical devices such as a multi-stage peg holder, or the like. Examples of the deactivation method include mechanical deactivation methods using a fixing member such as a projection or a multi-stage peg holder, electrical deactivation methods by needle selection using an electrical needle selector such as an electromagnetic needle selector or a multi-stage piezoelectric actuator, and the like.

Furthermore, the present invention is directed to a knitting method using a needle selector for selecting needles by acting on either the needles or jacks, each needle and a jack corresponding thereto being engageable with each other and being inserted in the same needle groove, on a knitting member including needle grooves in a circular knitting machine, wherein each needle selected for welting or a butt of a jack corresponding thereto is detached from a cam for performing stitching, to after a stitch position, so that guidance by the cam is deactivated.

With this method, the needle selected for welting or the jack corresponding thereto is not guided by the cam for performing stitching because the butt has been detached from the cam at the stitch position, and the needle does not perform stitching, and thus the load on old loops generated by performing stitching can be suppressed, and breakage and overlapping of yarns and filaments can be suppressed.

In this method, there is no limitation on when to detach each needle selected for welting or a butt of a jack corresponding thereto, from the cam for performing stitching, that is, the needle or the butt of the jack corresponding thereto may be detached from the cam for performing stitching at the time of needle selection for welting and the detached state may be maintained to after the stitch position, or the butt may be once returned to the cam after needle selection for welting and may be then detached again to after the stitch position. The stitch position refers to the lowest position in a cam race for drawing in a fed yarn in a lateral direction, which is a rotational direction of the knitting machine. The upper-lower relationship is such that the hook direction of a needle is set to the upper direction and the tail direction of the needle on the opposite side is set to the lower direction. The height direction is set to the upper-lower direction.

It is preferable that the needle selected for welting or the butt of the jack corresponding thereto is detached from the cam for performing stitching, at a position that is immediately before the stitch position and that is at a height for welting. Accordingly, the needle for welting moves completely laterally without being lowered, and breakage and overlapping of yarns and filaments can be suppressed without applying a load on the loops. It will be appreciated that any position higher than the stitch position may be included in the scope of the present invention, even if it is not the height for welting.

It is preferable that the needle selected for welting or the jack corresponding thereto is pushed in a direction opposite from the cam so that the butt is detached from the cam.

For example, the jack itself may be pushed by directly pushing the butt of the jack with a peg, or the jack may be indirectly pushed by pushing the butt of the second jack with a peg, the second jack being a jack that is inserted in the same groove as the above-described jack and is provided so as to be capable of being in contact with the jack. Note that instead of the peg, it is also possible to use a projection member that is provided on a route where only the above-described jack or the second jack corresponding to the needle selected for welting passes, and that uniformly pushes the jack or the second jack. The peg may be electrically controlled as to whether or not to push the butt, or the peg may be a mechanical device that is set before the circular knitting machine operating. Accordingly, the needle or the butt of the jack engaged with the needle is detached from the cam for performing stitching, and thus guidance by the cam to the stitch position can be deactivated.

Furthermore, the present invention is directed to a knitting mechanism in a circular knitting machine, including a knitting member including needle grooves, needles respectively accommodated in the needle grooves, jacks each of which is engageable with a needle corresponding thereto and is inserted in the same groove as the needle, and a needle selector for selecting the needles by acting on either the needles or the jacks, wherein the knitting mechanism includes a deactivation means for detaching each needle selected for welting or a butt of a jack corresponding thereto from a cam for performing stitching, from before a stitch position to after the stitch position.

With this knitting mechanism, the needle selected for welting or the butt of the jack corresponding thereto is detached from the cam for performing stitching at the stitch position by the deactivation means, and thus guidance by the cam to the stitch position can be deactivated.

It is preferable that the deactivation means operates when a butt of the needle is at a position that is immediately before the stitch position and that is at a height for welting. Accordingly, the needle for welting moves completely laterally without being lowered, and breakage and overlapping of yarns and filaments can be suppressed without applying a load on the loops. It will be appreciated that any means that operates at a position higher than the stitch position may be included in the scope of the present invention even if it is not at the height for welting.

Furthermore, the position at which the deactivation means is provided is not limited to a position facing the needle or the jack, and may also be a position facing a second jack that is inserted in the same groove as the above-described jack and is provided so as to be capable of being in contact with the jack. Accordingly, the deactivation means is not limited to a means that directly acts on the needle or the jack, and may also be a means that indirectly acts on the jack by acting on the second jack.

It is preferable that the deactivation means directly or indirectly pushes the needle or the jack. For example, the jack itself may be pushed by directly pushing the butt of the jack with a peg, or the jack may be indirectly pushed by pushing the butt of the second jack with a peg. Note that instead of the peg, it is also possible to use a projection member that is provided on a route where only the above-described jack or the second jack corresponding to the needle selected for welting passes, and that uniformly pushes the jack or the second jack. The peg may be electrically controlled as to whether or not to be at a position for pushing the butt, or the peg may be a mechanical device that is set before the circular knitting machine operating. Accordingly, the needle or the butt of the jack engaged with the needle is detached from the cam for performing stitching, and thus guidance by the cam can be deactivated.

Furthermore, the present invention is directed to a circular knitting machine including the above-described knitting mechanism.

DETAILED DESCRIPTION OF THE INVENTION

Example 1

Figure 1:
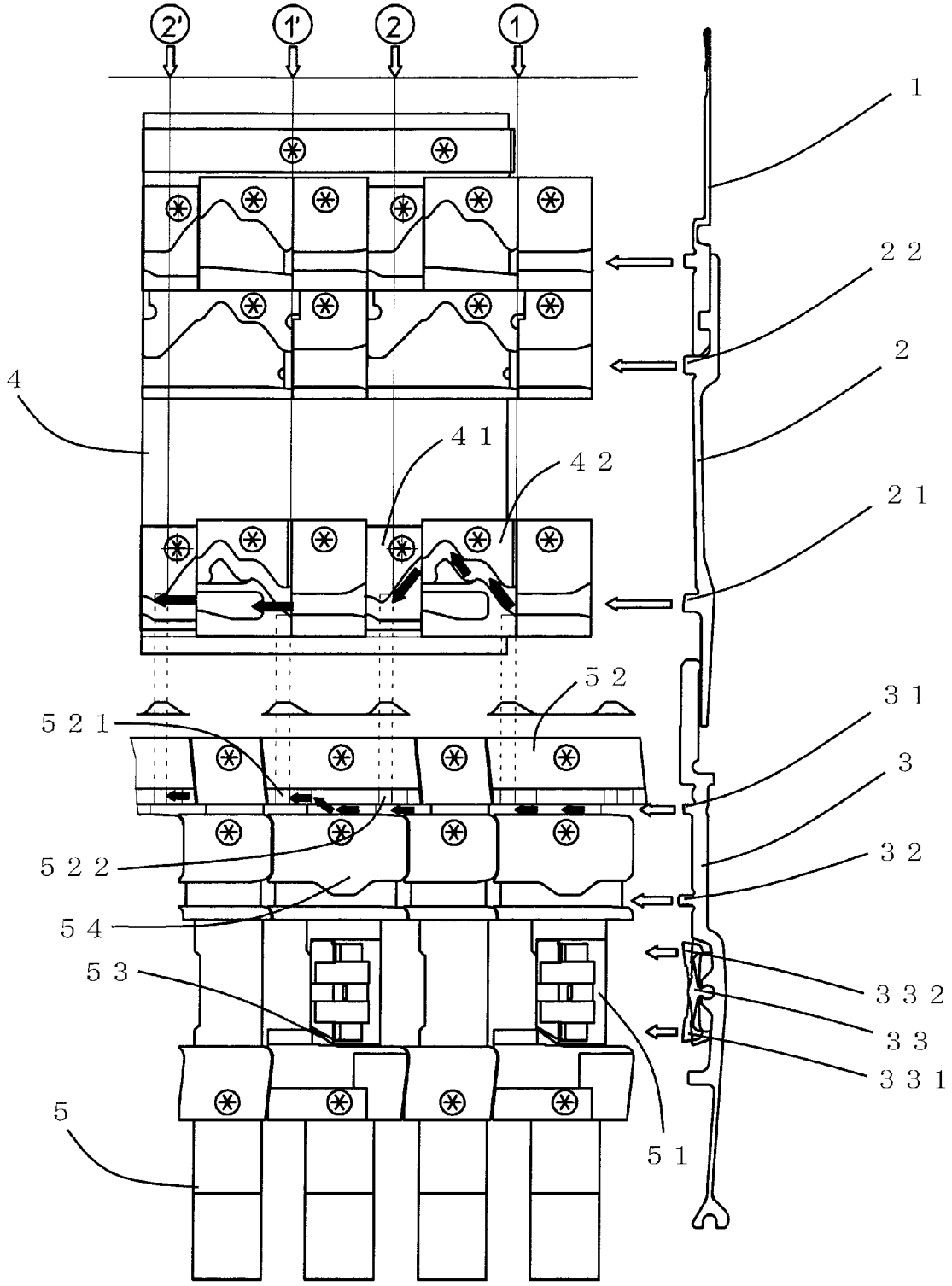
FIG. 1 is a front view of a cam holder of a knitting machine in Example 1 of the present invention, and a side view of a needle and jacks corresponding thereto.

Hereinafter, Example 1 of the present invention will be described with reference to the drawings. FIG. 1 shows a front view of a cam holder of a knitting machine in Example 1 of the present invention, and a side view of a needle and jacks corresponding thereto. In this example, a needle 1, an intermediate jack 2 that is provided on the lower portion of the needle 1 so as to be engaged with and move in one piece with the needle 1, and a selecting jack 3 that is provided on the lower portion of the intermediate jack 2 so as to be capable of being in contact with the intermediate jack 2, are inserted in the same needle groove provided on a cylinder, which is a knitting member of a circular knitting machine.

Furthermore, cams are provided so as to face the needle 1 and butts of the intermediate jack 2 via a cam holder 4. In this example, the intermediate jack 2 has upper and lower butts 22 and 21, and a stitch cam 41 for performing stitching and a jack raising cam 42 for raising a jack are alternately provided as cams facing the lower butt 21, along the rotational direction of the knitting machine. A structure is employed in which the lower butt 21 is lowered as guided by the stitch cam 41, and the intermediate jack 2 and the needle 1 engaged therewith are also lowered, so that stitching is performed. The cams facing the needle 1 and the upper butt 22 are not provided with a stitch portion, and the corresponding portion has a structure whereby lateral movement occurs at a welt position. Furthermore, the cam race of the jack raising cam 42 has a knit route, and is further provided with a groove at the welt position from a portion after first raising the lower butt 21 in the jack raising cam 42 to an end of the jack raising cam 42, so that, if the butt is detached from the cam at that first portion, the welt route can be traced.

The portion where the intermediate jack 2 and the selecting jack 3 are in contact with each other is set such that the intermediate jack 2 is positioned on the inner side and the selecting jack 3 is positioned on the outer side with respect to the rotational direction of the knitting machine, and, when the selecting jack 3 is pushed to the inner side, the intermediate jack 2 is pushed by the selecting jack 3 and is also pushed to the inner side.

Furthermore, an electromagnetic actuator 51 and a cam are provided so as to face the selecting jack 3 via an actuator holder 5. The selecting jack 3 has a push butt 31 at a position that is lower than the contact position with the intermediate jack 2 disposed on the upper portion of the selecting jack 3, and that is slightly higher than the center of the entire selecting jack 3, has a middle butt 32 at a position that is lower than the push butt 31, and is further provided with a rocking piece 33 at a position that is lower than the middle butt 32 and that is slightly lower than the center of the entire selecting jack 3. A push cam 52 including projections 521 and 522 is provided at a position that is higher than the push butt 31 and that is not in contact with the push butt 31, so as to face the selecting jack 3. The positional relationship is set such that the push butt 31 is not in contact with any projections in a usual state, but, when the selecting jack 3 is raised, the push butt 31 is brought into contact with the projections 521 and 522. The electromagnetic actuator 51 is provided so as to face the rocking piece 33.

Figures 2A, 2B, 2C, 2D:
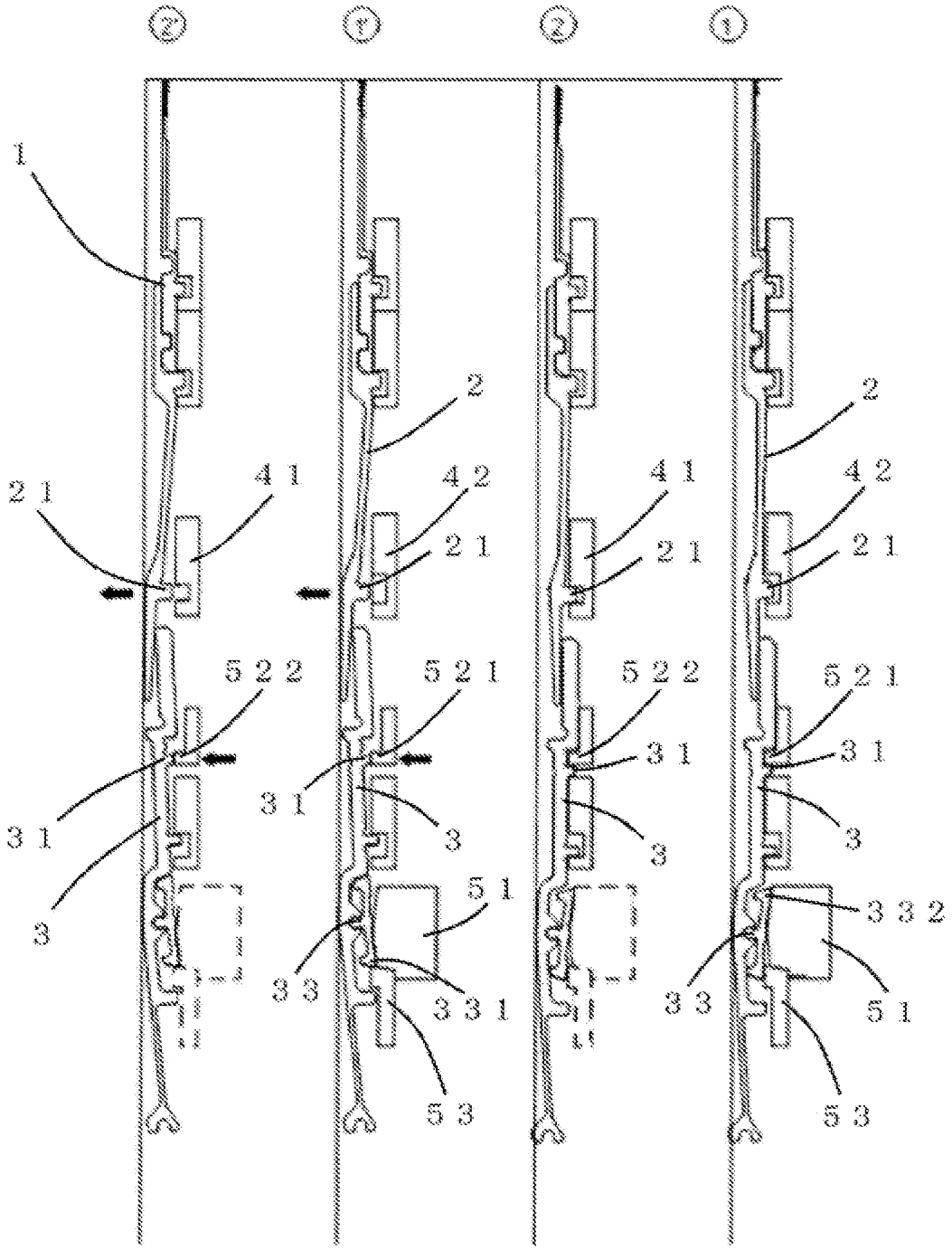
FIG. 2A is a cross-sectional view of the knitting machine at a position 1 in FIG. 1.
FIG. 2B is a cross-sectional view of the knitting machine at a position 2 in FIG. 1.
FIG. 2C is a cross-sectional view of the knitting machine at a position 1' in FIG. 1.
FIG. 2D is a cross-sectional view of the knitting machine at a position 2' in FIG. 1.

FIG. 2A is a cross-sectional view of the knitting machine at a position 1 in FIG. 1, FIG. 2B is a cross-sectional view of the knitting machine at a position 2 in FIG. 1, FIG. 2C is a cross-sectional view of the knitting machine at a position 1' in FIG. 1, and FIG. 2D is a cross-sectional view of the knitting machine at a position 2' in FIG. 1. This example will describe needle selection from two positions consisting of knit and welt. The needle selection process is such that, in the case of welt, when a needle selection data signal is received, the electromagnetic actuator operates to draw in a lower portion 331 of the rocking piece 33, so that, as shown in FIG. 2C, the lower end of the rocking piece 33 is placed on a raising cam 53, the rocking piece 33 is raised, the selecting jack 3 is also raised, the push butt 31 is pushed by the projection 521, the selecting jack 3 is also pushed, the intermediate jack 2 is pushed accordingly, and thus the lower butt 21 of the intermediate jack 2 is detached from the cam, and thus a welt is made. In the case of knit, as shown in FIG. 2A, an upper portion 332 of the rocking piece 33 is drawn in so that the rocking piece is not placed on the raising cam 53 and the selecting jack 3 is not raised, and therefore due to the push butt 31 passing under the projection 521, and thus the intermediate jack 2 is raised without being detached because the lower butt 21 is guided by the jack raising cam 42, and thus a knit is made.

In this example, the projection 522 is provided at the stitch position of the push cam 52. Accordingly, as shown in FIG. 2D, the selecting jack 3 corresponding to the needle 1 selected for welting moves to the stitch position while maintaining the raised state, after which the push butt 31 is uniformly pushed by the projection 522, the lower butt 21 of the intermediate jack 2 is detached from the stitch cam 41, and thus the guiding of the needle 1 to stitching is avoided, and the needle can move laterally while maintaining the welt position. Accordingly, the needle selected for welting avoids being used for stitching. On the other hand, as shown in FIG. 2B, in the case of a needle selected for knitting, since the selecting jack 3 is not raised, the push butt 31 passes under the projection 522, and thus the lower butt 21 of the intermediate jack 2 moves for stitching as guided by the cam without being detached from the stitch cam 41.

This example describes the configuration of needle selection from two positions consisting of knit and welt. In this example, the projection 522 is merely provided at the stitch position, but it is also possible to apply a configuration in which a needle selector is provided in front of the projection 522, all selecting jacks 3 are temporarily lowered by middle cams 54 facing the middle butts 32 before reaching the needle selector, after which a needle first selected for welting is again selected by the needle selector, and the selecting jack 3 is again raised so that the push butt 31 is pushed by the projection 522 at the stitch position, and the needle selected for welting does not perform stitching and is kept at the welt position. According to this configuration, if needle selection from knit and tuck is performed by providing an actuator also at a portion where needle selection is to be performed from knit and tuck, needle selection from three positions consisting of knit, tuck, and welt becomes possible.

In this example, the selecting jack is raised in the case of needle selection for welting, and the selecting jack is caused to move laterally without being raised in the case of needle selection for knitting, but the opposite configuration is also possible. As long as a projection is provided at the stitch position and the settings are made such that a needle selected for welting or a butt of a jack corresponding thereto is positioned at a height where the projection is provided and a needle selected for knitting or a butt of a jack corresponding thereto is positioned at a height that is different from the height where the projection is provided, after the needle selected for welting or the jack corresponding thereto moves to the stitch position, the push butt is uniformly pushed by the projection so that the lower butt can be detached from the cam, and the needle selected for welting avoids being used for stitching.

Example 2

Figure 3:
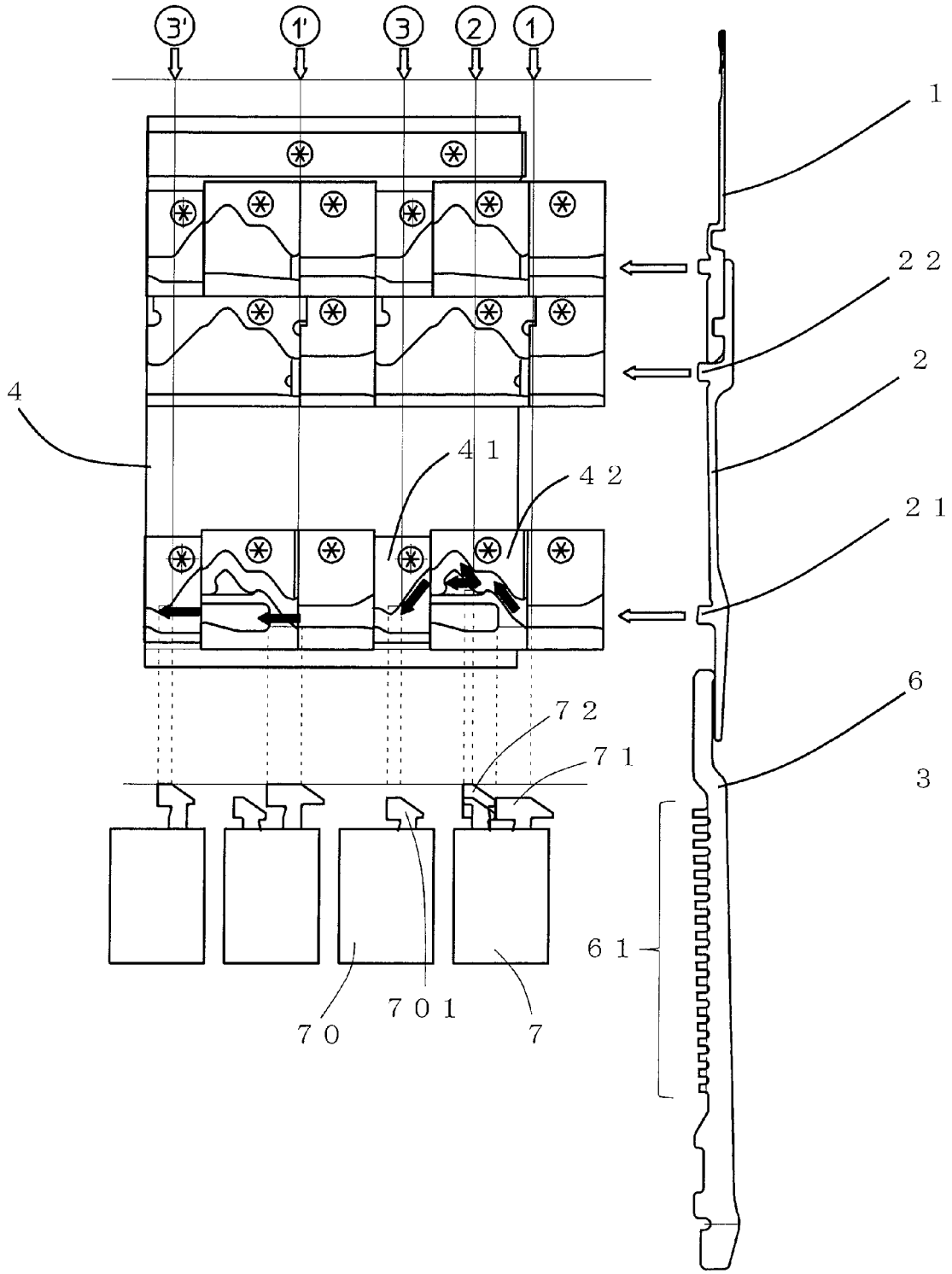
FIG. 3 is a front view of a cam holder of a knitting machine in Example 2 of the present invention, and a side view of a needle and jacks corresponding thereto.

Hereinafter, Example 2 of the present invention will be described with reference to the drawings. FIG. 3 shows a front view of a cam holder of a knitting machine in Example 2 of the present invention, and a side view of a needle and jacks corresponding thereto. In this example, a patterning jack 6 is used instead of the selecting jack 3 of Example 1.

The patterning jack 6 is provided with a patterning butt 61 including several to several tens of vertically arranged butts, and a multi-stage piezoelectric actuator 7 including a peg 71 corresponding to each butt position of the patterning butt 61 is provided so as to face the patterning butt 61.

Figures 4A, 4B, 4C, 4D, 4E:
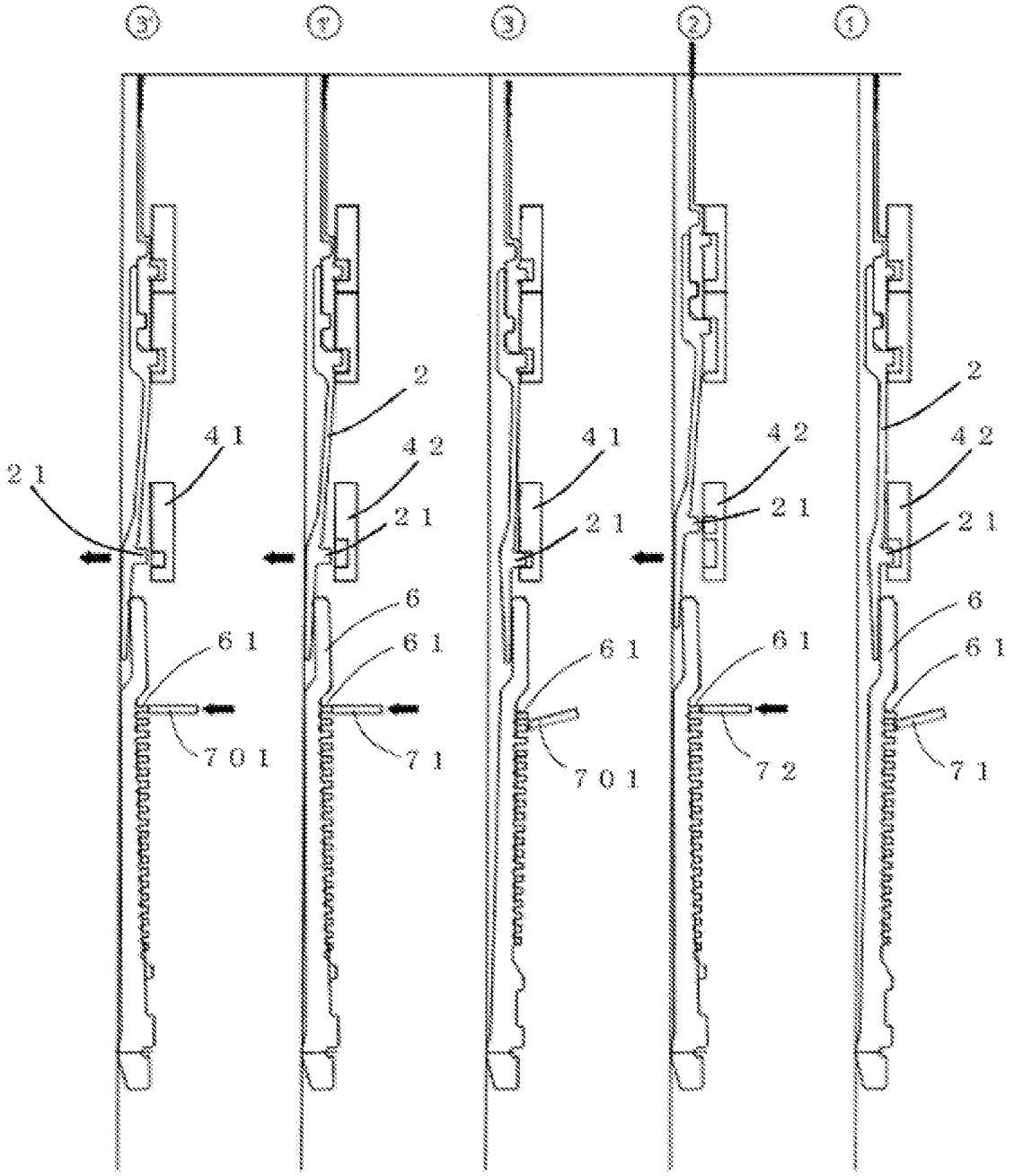
FIG. 4A is a cross-sectional view of the knitting machine at a position 1 in FIG. 3.
FIG. 4B is a cross-sectional view of the knitting machine at a position 2 in FIG. 3.
FIG. 4C is a cross-sectional view of the knitting machine at a position 3 in FIG. 3.
FIG. 4D is a cross-sectional view of the knitting machine at a position 1' in FIG. 3.
FIG. 4E is a cross-sectional view of the knitting machine at a position 3' in FIG. 3.

FIG. 4A is a cross-sectional view of the knitting machine at a position 1 in FIG. 3, FIG. 4B is a cross-sectional view of the knitting machine at a position 2 in FIG. 3, FIG. 4C is a cross-sectional view of the knitting machine at a position 3 in FIG. 3, FIG. 4D is a cross-sectional view of the knitting machine at a position 1' in FIG. 3, and FIG. 4E is a cross-sectional view of the knitting machine at a position 3' in FIG. 3. The needle selection process is such that when a needle selection data signal is received, the peg 71 of the multi-stage piezoelectric actuator 7 operates, and thus if the peg 71 is activated as shown in FIG. 4D, the peg 71 is horizontally oriented to be brought into contact with the patterning butt 61 and pushes the patterning butt 61 so that the patterning jack 6 is pushed accordingly and the intermediate jack 2 is also pushed, and the lower butt 21 is detached from the cam. On the other hand, if the peg 71 is deactivated as shown in FIG. 4A, the peg 71 is oriented downward to pass under the patterning butt 61 so that the lower butt 21 is not detached from the cam.

In this example, the multi-stage piezoelectric actuator 7 is provided not only at a first needle selection position where needle selection is performed between knit & tuck and welt, but also at a second needle selection position where needle selection is performed between knit and tuck, and a third needle selection position, which is a stitch position where needle selection is performed so as to prevent a needle selected for welting from performing stitching.

At the first needle selection position, the peg 71 is activated as shown in FIG. 4D for a needle selected for welting, and is deactivated as shown in FIG. 4A for a needle selected for knitting or tucking. At the second needle selection position, if the lower butt 21 corresponding to the needle 1 that has been raised to the tuck position as guided by the cam as a result of the needle selection at the first needle selection position is detached from the cam at the tuck position, the needle moves laterally while maintaining that position, and thus a tuck is made. Thus, in the case of needle selection for tucking, a peg 72 is activated as shown in FIG. 4B, and, in the case of needle selection for knitting, the peg is deactivated. At the third needle selection position, a multi-stage piezoelectric actuator 70 is provided instead of the projection 522 at the stitch position of Example 1, where a peg 701 is activated only for a needle selected for welting and pushes the patterning butt 61, so that the lower butt 21 is detached from the cam, and the needle selected for welting avoids being used for stitching. A needle selected for knitting or tucking is lowered as guided by the stitch cam 41 and performs stitching.

Accordingly, 3-position knitting consisting of knit, tuck, and welt can be performed such that only a needle selected for welting does not perform stitching and moves laterally while maintaining the welt position, whereas a needle selected for knitting or tucking performs stitching.

In this example, a multi-stage piezoelectric actuator is used, but it may be replaced by a multi-stage peg holder. Accordingly, a semi jacquard pattern can be knitted in which no pattern change is performed while the knitting machine is operating.

Several preferred embodiments have been thus described with reference to the drawings, but a person skilled in the art would easily arrive at various changes and modifications within an obvious range from the specification. Thus, such changes and modifications are construed as falling within the scope of the present invention defined by the appended claims.

What is claimed is:

1. A knitting mechanism in a circular knitting machine, comprising a knitting member including needle grooves, needles respectively accommodated in the needle grooves, jacks each of which is engageable with a needle corresponding thereto and is inserted in the same groove as the needle, and a needle selector for selecting the needles by acting on either the needles or the jacks, wherein the knitting mechanism comprises a deactivation means for detaching each needle selected for welting or a butt of a jack corresponding thereto from a cam for performing stitching, from before a stitch position to after the stitch position, wherein the deactivation means operates when a butt of the needle is at a position that is immediately before the stitch position and that is at a height for welting.

2. The knitting mechanism according to claim 1, wherein the deactivation means directly or indirectly pushes the needle or the jack.

3. The knitting mechanism according to claim 1, wherein the jack is constituted by a first jack that can be engaged with the needle and a second jack that can be in contact with the first jack and that is provided so as to face the deactivation means, the second jack is directly pushed by the deactivation means, and the first jack is indirectly pushed accordingly so that a butt of the first jack is detached from the cam for performing stitching.

4. The knitting mechanism according to claim 1, wherein a projection is provided as the deactivation means, each needle selected for welting or a butt of a jack corresponding thereto is positioned at a height where the projection is provided, each needle selected for knitting or a butt of a jack corresponding thereto is positioned at a height that is different from the height where the projection is provided, and after the needle selected for welting or the jack corresponding thereto moves to the stitch position, the butt is uniformly pushed by the projection so that the butt is detached from the cam.

5. The knitting mechanism according to claim 1, wherein a projection is provided as the deactivation means, an electromagnetic needle selector is provided before the stitch position, each needle selected for welting is again selected before the stitch position, the needle selected for welting or a butt of a jack corresponding thereto is positioned at a height where the projection is provided, other needles or butts of jacks corresponding thereto are positioned at a height that is different from the height where the projection is provided, and after the needle selected for welting or the jack corresponding thereto moves to the stitch position, the butt is uniformly pushed by the projection so that the butt is detached from the cam.

6. The knitting mechanism according to claim 1, wherein a multi-stage piezoelectric actuator is provided as the deactivation means, each needle selected for welting or a jack corresponding thereto is again selected before the stitch position, and the needle selected for welting or a butt of the jack corresponding thereto is pushed by a peg of the multi-stage piezoelectric actuator so that the butt is detached from the cam.

7. The knitting mechanism according to claim 1, wherein a multi-stage peg holder is provided as the deactivation means, each needle selected for welting or a jack corresponding thereto is again selected before the stitch position, and the needle selected for welting or a butt of the jack corresponding thereto is pushed by a peg of the multi-stage peg holder so that the butt is detached from the cam.

* * * * *